US008157920B2

(12) United States Patent
Bragg

(10) Patent No.: US 8,157,920 B2
(45) Date of Patent: Apr. 17, 2012

(54) CONTROL DEVICE FOR A DISHWASHER APPLIANCE AND ASSOCIATED METHOD

(75) Inventor: Marita Louise Bragg, Goldsboro, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 810 days.

(21) Appl. No.: 11/954,293

(22) Filed: Dec. 12, 2007

(65) Prior Publication Data

US 2009/0151751 A1 Jun. 18, 2009

(51) Int. Cl.
*B08B 7/04* (2006.01)

(52) U.S. Cl. ..... 134/18; 134/25.2; 134/56 D; 134/57 D; 134/58 D

(58) Field of Classification Search ..... 134/18, 134/25.2, 26, 22.1, 56 D, 57 D, 58 D
See application file for complete search history.

(56) References Cited

U.S. PATENT DOCUMENTS

| | | | |
|---|---|---|---|
| 3,888,269 | A | 6/1975 | Bashark |
| 4,559,959 | A | 12/1985 | Meyers |
| 4,673,441 | A | 6/1987 | Mayers |
| 4,735,219 | A | 4/1988 | Seeland |
| 5,291,626 | A | 3/1994 | Molnar et al. |
| 5,411,042 | A | 5/1995 | Suzuki et al. |
| 5,438,507 | A | 8/1995 | Kim et al. |
| 5,560,060 | A | 10/1996 | Dausch et al. |
| 5,611,867 | A | 3/1997 | Cooper et al. |
| 5,806,541 | A | 9/1998 | Cooper et al. |
| 5,960,804 | A | 10/1999 | Cooper et al. |
| 6,007,640 | A | 12/1999 | Neff et al. |
| 6,887,318 | B2 | 5/2005 | Bashark |
| 7,086,406 | B2 | 8/2006 | Jung et al. |
| 2004/0111807 | A1 | 6/2004 | Jung et al. |
| 2007/0039357 | A1 | 2/2007 | Grimm et al. |
| 2008/0308127 | A1 | 12/2008 | Padtberg et al. |

FOREIGN PATENT DOCUMENTS

| | | | | |
|---|---|---|---|---|
| DE | 34 41 222 | A1 | | 5/1986 |
| DE | 10 2004 030 012 | A | | 1/2006 |
| DE | 10 2004 030 013 | A1 | | 1/2006 |
| JP | 041 871 36 | A | | 7/1992 |
| JP | 2001 346747 | A | | 12/2001 |
| JP | 2002177190 | A | * | 6/2002 |
| JP | 2007098112 | A | * | 4/2007 |
| WO | WO 2008/077970 | A1 | | 7/2008 |

OTHER PUBLICATIONS

Office Action for Chinese Application No. 200880120339.8 dated Jul. 5, 2011.

* cited by examiner

*Primary Examiner* — Alexander Markoff
(74) *Attorney, Agent, or Firm* — Alston & Bird LLP

(57) ABSTRACT

A dishwasher appliance is provided, and includes a control device configured to direct one of a series of automatic wash programs to be executed by the dishwasher appliance. Each successive automatic wash program within the series corresponds to an increased soil level of dishware to be washed with respect to the previous automatic wash program within the series. The control device is further configured to determine an elapsed time between a first and second uses of the dishwasher appliance and to select the one of the series of automatic wash programs in response thereto upon the second use, whereby, as the determined elapsed time between first and second uses increases, the selected automatic wash program within the series correspondingly progresses along the series. Associated methods are also provided.

9 Claims, 2 Drawing Sheets

CONTROL DEVICE FOR A DISHWASHER APPLIANCE AND ASSOCIATED METHOD

BACKGROUND OF THE INVENTION

1. Field of the Invention

Figure 1:
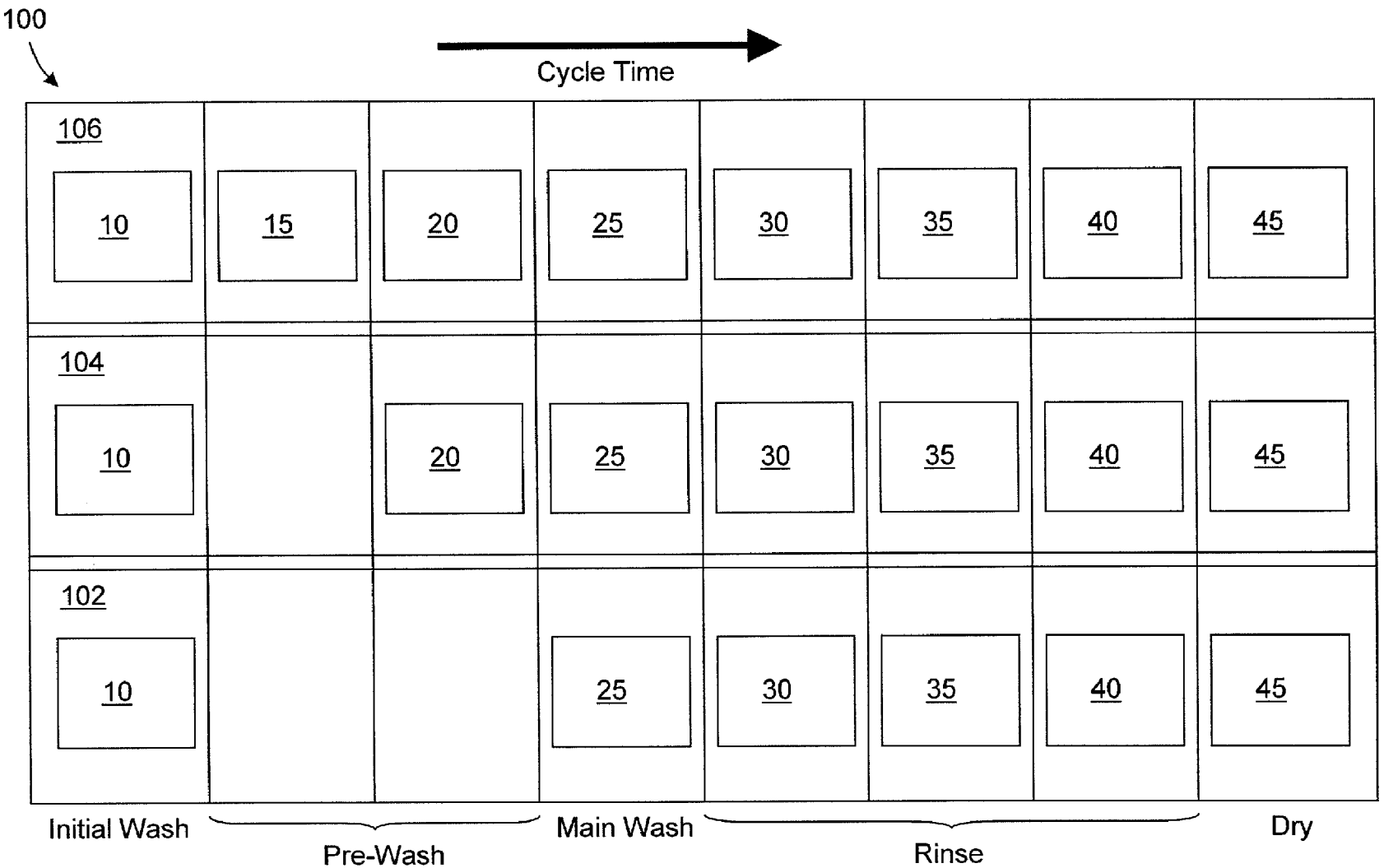

The present disclosure relates to dishwasher appliances and, more particularly, to a wash cycle control device for a dishwasher appliance and associated method.

2. Description of Related Art

A dishwasher appliance typically includes a number of selectable wash programs, wherein any one such wash program may be selected by the user depending on the nature of the load (i.e., a "normal" wash cycle for varying food soil levels on the dishware, a "china/crystal" wash cycle, an "economy" cycle, a "speed wash" cycle, a "rinse and hold" cycle, or an "automatic" cycle). In such instances, the selected wash program may adjust a number of different parameters that affect the particular wash cycle. That is, the selected cycle may have certain "pre-wash" characteristics, rinse characteristics, and "main wash" characteristics, including, for example, particular durations for each cycle segment, the order and number of cycle segments, the amount of water used, and the temperature of the water.

The intent of the various wash programs is to remove food soils and debris from the dishware therein. In doing so, however, various other factors such as, for example, water consumption, energy consumption, and the duration of the wash cycle must be considered in determining the effectiveness of a particular wash program.

These "other" factors of power consumption, water consumption, etc., may be adversely affected by draining and re-filling the dishwasher appliance (i.e., increased water usage, as well as energy usage due to the pump used for draining the water). As such, one area of interest is effective filtration of the water used in the various cycle segments, since the water used for washing the dishware is often recirculated over the dishware. Effective filtration leads to a more effective wash program since food soils are not recirculated back over the dishware. In addition, less draining and re-filling conserves water and energy, and may help to reduce the overall duration of the wash cycle.

However, when the dishwasher appliance is not used for extended periods, various less-than-desirable effects may be experienced, even with effective filtration systems. For example, any removed food soils in a previous wash cycle may remain within the filtration system, or elsewhere in the hydraulic system of the dishwasher appliance, and become "dried on" to affected surfaces. In addition, mold, mildew, and/or bacteria growth may occur in the damp environment of the dishwasher appliance between periods of use. As such, these undesirable elements have the potential of being circulated onto dishware being washed in the dishwasher appliance, when the dishwasher appliance is again used at a later time.

Thus, there exists a need for an apparatus and/or method for automatically cleaning, disinfecting, or otherwise removing undesirable contamination "build-up" in a dishwasher appliance after a period of non-use and before a subsequent use.

BRIEF SUMMARY OF THE INVENTION

The above and other needs are met by the present disclosure which, in one embodiment, provides a dishwasher appliance, including a control device configured to direct one of a series of automatic wash programs to be executed by the dishwasher appliance. Each successive automatic wash program within the series corresponds to an increased soil level of dishware to be washed with respect to the previous automatic wash program within the series. The control device is further configured to determine an elapsed time between a first use and a second use of the dishwasher appliance and to select the one of the series of automatic wash programs in response thereto upon the second use of the dishwasher appliance, whereby, as the determined elapsed time between first and second uses of the dishwasher appliance increases, the selected automatic wash program within the series correspondingly progresses along the series.

Another advantageous aspect of the present invention comprises a method for pre-cleaning a hydraulic system of a dishwasher appliance, wherein the dishwasher appliance has a control device configured to direct one of a series of automatic wash programs to be executed by the dishwasher appliance, with each successive automatic wash program within the series corresponding to an increased soil level of dishware to be washed with respect to the previous automatic wash program within the series. Such a method comprises determining an elapsed time between a first use and a second use of the dishwasher appliance and selecting one of the series of automatic wash programs in response to the determined elapsed time upon the second use of the dishwasher appliance, whereby, as the determined elapsed time between first and second uses of the dishwasher appliance increases, the selected automatic wash program within the series correspondingly progresses along the series.

Thus, the control device and associated method, as disclosed in conjunction with various embodiments of the present disclosure, provide many advantages that may include, but are not limited to providing a pre-cleaning procedure for the dishwasher appliance according to an elapsed time between uses of the dishwasher appliance.

BRIEF DESCRIPTION OF THE SEVERAL VIEWS OF THE DRAWING(S)

Figure 2:
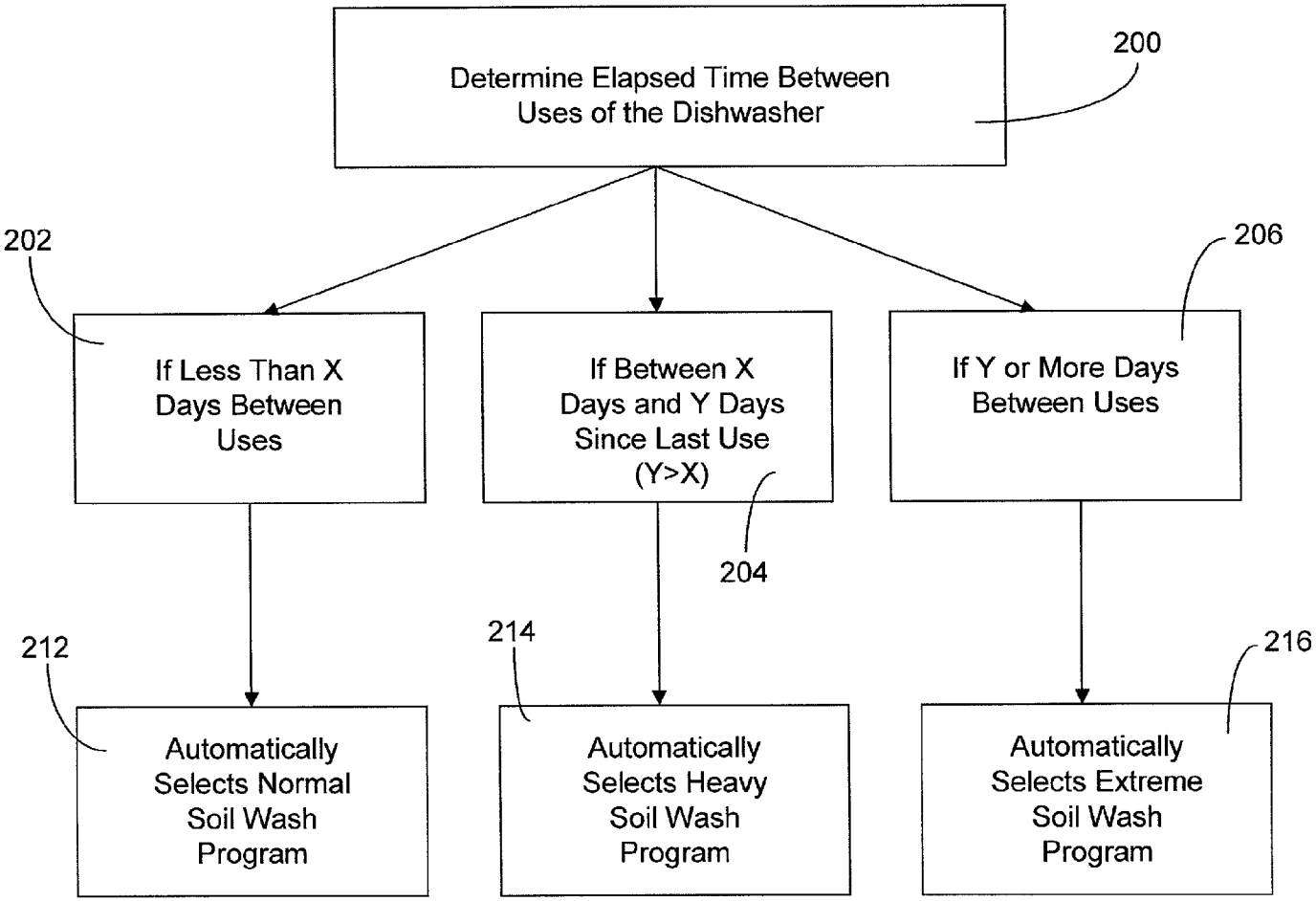

Having thus described the disclosure in general terms, reference will now be made to the accompanying drawings, which are not necessarily drawn to scale, and wherein:

FIG. 1 is a table illustrating one embodiment according to the present disclosure of a plurality of wash programs selectable as determined by an elapsed time between uses of a dishwasher appliance; and FIG. 2 is a flowchart illustrating one particular embodiment of wash programs for a dishwasher appliance corresponding to a determined elapsed time between uses thereof in accordance with the present disclosure.

DETAILED DESCRIPTION OF THE INVENTION

The present disclosure now will be described more fully hereinafter with reference to the accompanying drawings, in which some, but not all embodiments of the disclosure are shown. Indeed, this disclosure may be embodied in many different forms and should not be construed as limited to the embodiments set forth herein; rather, these embodiments are provided so that this disclosure will satisfy applicable legal requirements. Like numbers refer to like elements throughout.

A dishwasher appliance typically includes a number of selectable wash programs that are configured to adjust various parameters of the dishwashing process for a particular wash cycle. Depending on the nature of the load, a user may select, for example, a "normal" wash cycle for varying food soil levels on the dishware, a "china/crystal" wash cycle, an "economy" cycle, a "speed wash" cycle, a "rinse and hold" cycle, or an "automatic" cycle. Such wash programs may be selectable by the user on a display screen or touch pad disposed on a control panel or control device generally integrated into a portion of a pivotable door connected to the dishwasher appliance. The control panel typically includes or communicates with a control circuit (or control device portion) configured to facilitate varying the parameters consistent with the wash cycle selected by the user. That is, the user selects the wash cycle by, for example, pressing a button or other input device on the touch pad associated with the desired wash cycle such that the information is transferred to the control circuit for processing by, for instance, a microprocessor operable therewith to set the parameters used by the various dishwasher appliance components to effectuate the selected wash cycle. Accordingly, the parameters such as, for example, particular durations for each cycle segment, the temperature of the water, and the amount of water used may be adjusted and controlled by the control circuit or other control device, as will be appreciated by one skilled in the art.

Normally, the control circuit is also in communication with one or more sensors such as, for example, a turbidity sensor, which measures the amount of particulate suspended in the water within the dishwasher appliance as the water re-circulates through the dishwasher appliance's hydraulic system and through the spray arms for cleaning the dishware. Such a turbidity sensor may employ, in some instances, optical techniques (e.g., monitoring scattered or transmitted light with photodiodes to measure turbidity voltage) so as to collect data relating to turbidity, which is transmitted to the control circuit. Accordingly, it may be determined whether additional wash cycles are needed to further clean the dishware, based on the amount of particulates remaining in the water as the water is re-circulated through the system via a circulation pump. That is, when the turbidity exceeds a threshold level due to food soils removed from the dishware, an additional wash cycle or cycle segment may be necessary to sufficiently clean the dishware.

To that end, the control circuit may be configured to automatically facilitate such an additional wash cycle or cycle segment (or cycle portion) through, for example, predetermined automatic wash programs, each having a particular programmed sequence and duration of cycle segments. In this manner, these programs may be considered "intelligent" or "pseudo-intelligent" automatic wash programs. Thus, while these programs may be initially selected by a user based on what the user deems as the appropriate wash cycle needed to clean the dishware, the intelligent automatic wash programs may, in addition to or in the alternative, determine the appropriate automatic wash cycle necessary to clean the dishware based, for example, on turbidity measurements of the wash water in an initial wash cycle segment, regardless of the automatic wash program selected by the user.

For example, a dishwasher appliance may be configured to follow such a protocol in which an automatic wash program is selected depending on the turbidity of the water after an initial wash cycle segment run in the dishwasher appliance, as illustrated in the table of FIG. 1. According to one particular intelligent automatic wash scheme 100, the dishwasher appliance may include two or more automatic wash programs such as, for example, a "normal" soil 102, a "heavy" soil 104, and an "extreme" soil 106 automatic wash program, each of which may be manually selectable by the user on the control panel of the dishwasher appliance. In one instance, the two or more automatic wash programs may be considered a "series" of automatic wash programs, with each subsequent selection having a configuration sufficient to address the increasing soil levels which may be encountered in the dishes placed within the dishwasher appliance. In such an embodiment, the "normal" soil automatic wash program 102 may include, for example, an initial wash cycle segment 10 wherein the turbidity of the wash water is monitored. Monitoring of the turbidity may occur at discrete instances or intervals during the initial wash cycle segment 10, or dynamically throughout the initial wash cycle segment 10. If the turbidity remains stable or below a certain threshold, the "normal" soil automatic wash program 102 proceeds (horizontally across the row) to a main wash cycle segment 25, which is programmed to use high temperature heated water (e.g., 140° F.). The main wash cycle segment 25 may then be followed by a turbidity-monitored rinse cycle segment 30 (and an additional rinse cycle segment 35 if the turbidity of the water is or remains high), and then a final rinse cycle segment 40, before a drying phase cycle segment 45.

If the turbidity is erratic, or above a certain threshold, in the initial wash cycle segment 10 of the "normal" soil automatic wash program 102, the selected automatic wash program may be automatically changed or otherwise altered to the "heavy" soil automatic wash program 104, or even further to the "extreme" soil automatic wash program 106, depending, for instance, on the magnitude of the detected turbidity of the wash water in the initial wash cycle segment 10. In each successive automatic wash program in the disclosed intelligent automatic wash scheme 100, a pre-wash cycle segment 20 may be added after the initial wash cycle segment 10 and prior to the main wash cycle segment 25 (i.e., the "heavy" soil program 104 having a single pre-wash cycle segment 20 that may or may not be turbidity-monitored, and the "extreme" soil automatic wash program 106 having two pre-washes, with neither, both, or either one of the first and second pre-wash cycle segments 15 being turbidity-monitored). The remainder of the cycle segments of each wash program may have unique parameters or, in other instances, may be, for example, the same as the subsequent cycle segments in the "normal" soil automatic wash program 102.

Following this intelligent automatic wash scheme 100, in accordance with the present disclosure, it may be advantageous to further configure the control circuit to "pre-clean" the dishwasher appliance based on the duration of time between first and second uses thereof such that the series of automatic wash programs associated with intelligent automatic wash scheme 100 may also be employed according to a time-based criteria. That is, according to one embodiment, for example, the intelligent automatic wash scheme 100 may further include different time ranges or thresholds associated with each automatic wash program within the series. Such time ranges or thresholds may correspond, for example, to an elapsed time between successive uses of the dishwasher appliance, with a continuum of ranges being assigned to each of the automatic wash programs (normal soil 102, heavy soil 104, and extreme soil 106). Such a scheme may be configured to essentially track the amount of time elapsed between first and second uses of the dishwasher appliance, upon the second use thereof, and to adjust the selected "automatic" wash program, in order to "pre-clean" (or otherwise disinfect or remove any undesirable contamination from) the dishwasher appliance after an extended period of non-use.

For instance, as illustrated by the flowchart in FIG. 2, after determining the elapsed time between first and second uses 200 of the dishwasher appliance, when the second use is initiated, one of the automatic wash programs in the series is selected (according to the elapsed time criteria) to pre-clean the dishwasher appliance. That is, according to one particular embodiment, where the elapsed time between first and second uses is less than 3 days (202) (i.e., 0≦t<3 days), the control circuit automatically directs the dishwasher appliance to execute the "normal" soil automatic wash program 102 (212). However, if the elapsed time between first and second uses is between 3 days and 14 days (204) (i.e., 3 days≦t<14 days), the control circuit automatically directs the dishwasher appliance to execute the "heavy" soil automatic wash program 104 (214). Furthermore, if elapsed time between first and second uses is 14 days or greater (206) (i.e., t≧14 days), the controls circuit automatically directs the dishwasher appliance to execute the "extreme" soil automatic wash program 106 (216). That is, the greater the elapsed time (as determined according to assigned time ranges or thresholds), the higher the selected automatic wash program within the series of automatic programs that will be selected by the control circuit to "pre-clean" the dishwasher appliance prior to the subsequent or second use. One skilled in the art will appreciate, however, that the durational ranges disclosed herein are provided only for exemplary purposes and it is envisioned that such limits may be varied in any manner as necessary or otherwise desirable in keeping within the spirit of the present disclosure in addressing the "pre-cleaning of the dishwasher appliance after an extended period of non-use.

Further, according to some embodiments, in instances of power interruption to the dishwasher appliance, the intelligent automatic wash scheme 100 may be configured to default, for example, to either of the heavy soil 104 or extreme soil 106 automatic wash programs. In this manner, any "build-up" or other contamination in the dishwasher appliance due to periods of non-use is addressed in conjunction with a later use of the dishwasher appliance. That is, if power to the dishwasher appliance is interrupted, the control circuit automatically selects one of the higher automatic wash programs in the series, under the presumption that, after such power interruption (not knowing how long the interruption may last) it may be desirable to provide the maximum amount of "pre-cleaning" prior to the subsequent or second use of the dishwasher appliance when power is restored.

In accordance with the present disclosure, the dishwasher appliance may include a control device (not shown) configured to determine an elapsed time between first and second uses of the dishwasher appliance, upon the second use of the dishwasher appliance and to select one of a series of automatic wash programs in response to the determined elapsed time between first and second uses. The control device may comprise, for example, a control circuit and/or associated microprocessors for effectuating automatic selection of an appropriate automatic wash program within the series of automatic wash programs in accordance with the determined elapsed time between first and second uses of the dishwasher appliance upon the second use thereof. Accordingly, the dishwasher appliance may be pre-cleaned by providing, for example, one or more additional pre-washes for flushing the hydraulic system of the dishwasher appliance to remove any built-up particulate (i.e., food particles) or other contaminants remaining or developing within the system after the last use of the dishwasher.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwasher appliance, comprising:

a circulation pump configured to circulate water through one or more spray arms; and a control device configured to control the circulation pump and direct one of a series of automatic wash programs for washing dishware to be executed by the dishwasher appliance, each successive one of the automatic wash programs within the series corresponding to an elapsed time between a first use and a second use of the dishwasher appliance for washing dishware and configured to clean an increased soil level with respect to a previous automatic wash program within the series, the control device being further configured to determine the elapsed time between the first use and the second use and to select the one of the series of automatic wash programs in response thereto upon initiation of the second use of the dishwasher appliance for washing dishware, whereby, as the elapsed time between the first use and the second use of the dishwasher appliance increases, the one of the automatic wash programs within the series that is selected correspondingly progresses along the series.

2. A dishwasher appliance according to claim 1, wherein each one of the series of automatic wash programs has an elapsed time range associated therewith, and the control device is further configured to select the one of the series of automatic wash programs having the elapsed time range including the elapsed time.

3. A dishwasher appliance according to claim 1, wherein the control device is further configured to select a first automatic wash program in the series when the elapsed time between the first use and the second use is below a time threshold and selecting a subsequent second automatic wash program in the series when the elapsed time is at least equal to the time threshold.

4. A dishwasher appliance according to claim 1, wherein each one of the automatic wash programs includes an initial wash portion and a main wash portion.

5. A dishwasher appliance according to claim 4, wherein a first automatic wash program includes the initial wash portion and the main wash portion, and each successive one of the automatic wash programs within the series includes an additional pre-wash portion between the initial wash portion and the main wash portion as compared to a previous automatic wash program within the series.

6. A method for washing dishware by selecting one of a series of automatic wash programs to be executed by a dishwasher appliance, each successive one of the automatic wash programs within the series corresponding to an elapsed time between a first use and a second use of the dishwasher appliance for washing dishware and configured to clean an increased soil level with respect to a previous automatic wash program within the series, the method comprising:

executing one of the automatic wash programs during the first use of the dishwasher appliance for washing dishware;

initiating the second use of the dishwasher appliance for washing dishware;

determining the elapsed time between the first use and the second use of the dishwasher appliance; and selecting one of the series of automatic wash programs for execution during the second use in response to the elapsed time upon initiating the second use of the dishwasher appliance, whereby, as the elapsed time between the first use and the second use of the dishwasher appliance increases, the one of the automatic wash programs within the series that is selected correspondingly progresses along the series.

7. A method according to claim 6, wherein each one of the series of automatic wash programs has an elapsed time range associated therewith, and selecting one of the series of automatic wash programs further comprises selecting one of the series of automatic wash programs having the elapsed time range including the elapsed time.

8. A method according to claim 6, wherein selecting one of the series of automatic wash programs further comprises selecting a first automatic wash program in the series when the elapsed time between first and second uses is below a time threshold and selecting a subsequent second automatic wash program in the series when the elapsed time is at least equal to the time threshold.

9. A method according to claim 8, wherein each one of the automatic wash programs includes an initial wash portion and a main wash portion, and selecting one of the series of automatic wash programs further comprises selecting the first automatic wash program, including the initial wash portion and the main wash portion, when the elapsed time is below the time threshold, and selecting a subsequent second automatic wash program in the series when the elapsed time is at least equal to the time threshold, wherein each of the successive automatic wash programs within the series includes an additional pre-wash portion between the initial wash portion and the main wash portion as compared to a previous automatic wash program within the series.

* * * * *